United States Patent [19]

Vouyouka

[11] Patent Number: 4,565,006

[45] Date of Patent: Jan. 21, 1986

[54] TEMPLATE FOR USE IN GARMENT MANUFACTURE

[76] Inventor: Anastasia Vouyouka, 8, Amorgou St., Thessalonika, Greece

[21] Appl. No.: 674,320

[22] Filed: Nov. 23, 1984

[30] Foreign Application Priority Data

Nov. 25, 1983 [GB] United Kingdom ..... 8331529

[51] Int. Cl.[4] ..... A41H 1/00

[52] U.S. Cl. ..... 33/11; 33/12

[58] Field of Search ..... 33/11, 12, 14, 16, 2 R

[56] References Cited

U.S. PATENT DOCUMENTS 831,826 9/1906 Buccola ..... 33/11

FOREIGN PATENT DOCUMENTS 683417 2/1965 Italy ..... 33/11
317096 11/1956 Switzerland ..... 33/11
621247 1/1981 Switzerland ..... 33/11
17481 of 1894 United Kingdom ..... 33/11

*Primary Examiner*—Willis Little
*Attorney, Agent, or Firm*—Cushman, Darby & Cushman

[57] ABSTRACT

A template for marking out a pattern for the manufacture of garments. The template is a flat plate with a series of apertures having contours conforming in shape to a desired pattern and a series of scales marked on some of the contours representing different sizes.

12 Claims, 17 Drawing Figures

TEMPLATE FOR USE IN GARMENT MANUFACTURE

BACKGROUND OF THE INVENTION

The present invention relates to a template for marking out a pattern for the manufacture of garments.

In known systems for producing garment patterns it is necessary to use a range of templates for any one single garment and frequently it is necessary to carry out geometrical calculations. Thus, it tends to be very time-consuming and often very difficult to produce such a pattern.

SUMMARY OF THE INVENTION

It is an object of the present invention to provide a system which is simple to operate, requires no geometrical calculations and which can produce a range of sizes and basic garment designs. More specifically, it is an object to provide a single template which enables a designed to produce a range of complete basic garment designed, e.g. blouse, dress, trousers, in a wide range of sizes. It is a further object of the invention that the template be suitable for providing a perfect fit for bodies both of normal proportions and of unusual proportions.

According to the present invention, there is provided a template for marking a pattern for the manufacture of a garment comprising a flat plate having a series of apertures at least some of which have contours conforming in shape to the desired pattern and at least some of which are marked with scales representing different sizes.

With such a template it may be possible to draw patterns for a range of shapes and sizes of complete basic garments in dependence upon the size of the model and without the need for any geometrical calculations.

Preferably the contours of the apertures are marked with scales for forming the front of the garment on one side of the plate and on the other side of the plate for the rear of the garment. Thus, the front and back sections can be drawn using the same apertures simply by repeating the design procedure using the two sides of the template.

Preferably, the template has an aperture for marking a neckline curve; an aperture for marking shoulder and armhole curves and upper and lower sleeve curves, and an aperture for marking crotch curves for a trouser pattern.

Preferably, the template includes a scale or scales for use in connection with a chest width for marking neckline, shoulder, armhole and/or sleeve points; a scale or scales for use in connection with the difference between chest and bust widths for marking shoulder and waist darts; a scale or scales for use in connection with waist and hip widths for marking waist and hip dimensions; a scale or scales for use in connection with the difference between waist and hip widths for marking dart lines for a skirt or trousers which match precisely the corresponding waist dart lines of the bodice; a scale or scales for use in connection with a hip width for marking trouser points; and a scale or scales for marking a sleeve pattern.

Preferably, the template includes indication marks at certain of the apertures at positions correlating lines of the pattern already drawn with further lines to be drawn.

Preferably, the template is generally rectangular or square and has scales marked in units such as centimeters or inches along one or more of its edges. It is preferably 2 to 3 cm thick and may be made of wood, metal or any other suitable material such as a plastics material.

DESCRIPTION OF THE PREFERRED EMBODIMENT

Figure 1A:
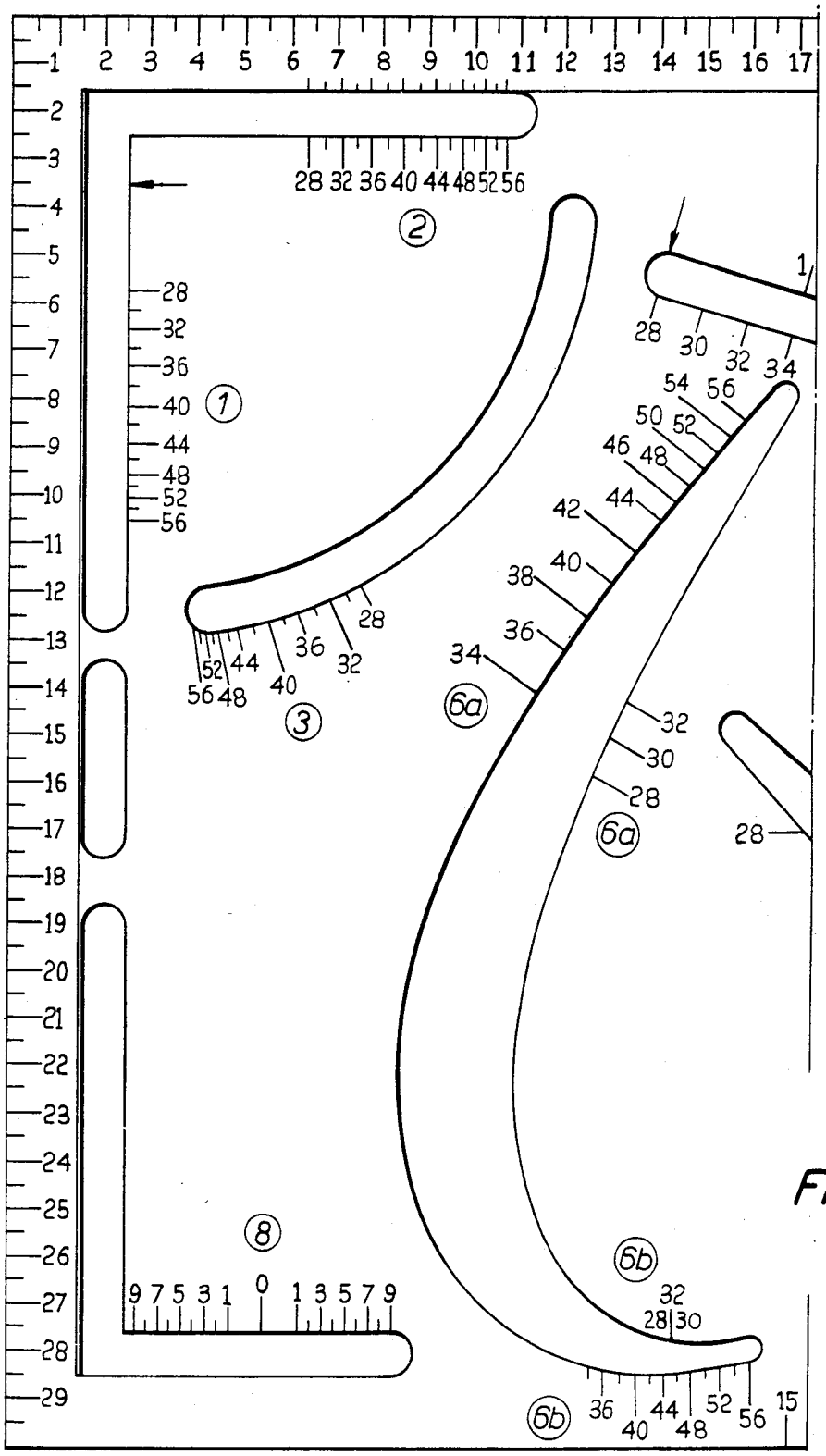
FIGS. 1A and 1B show one side of a template in accordance with the invention.
Figure 1B:
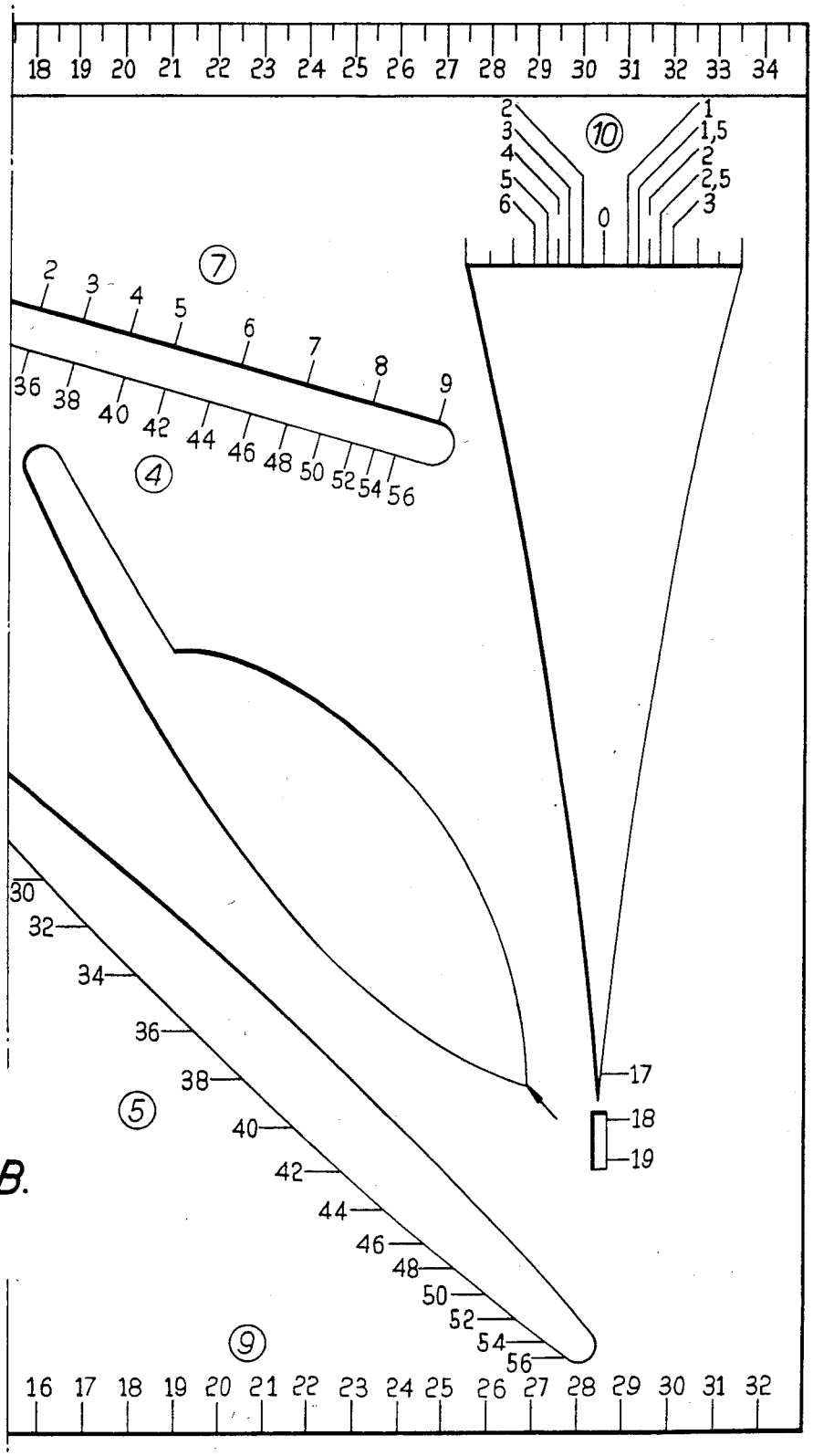
Figure 2A:
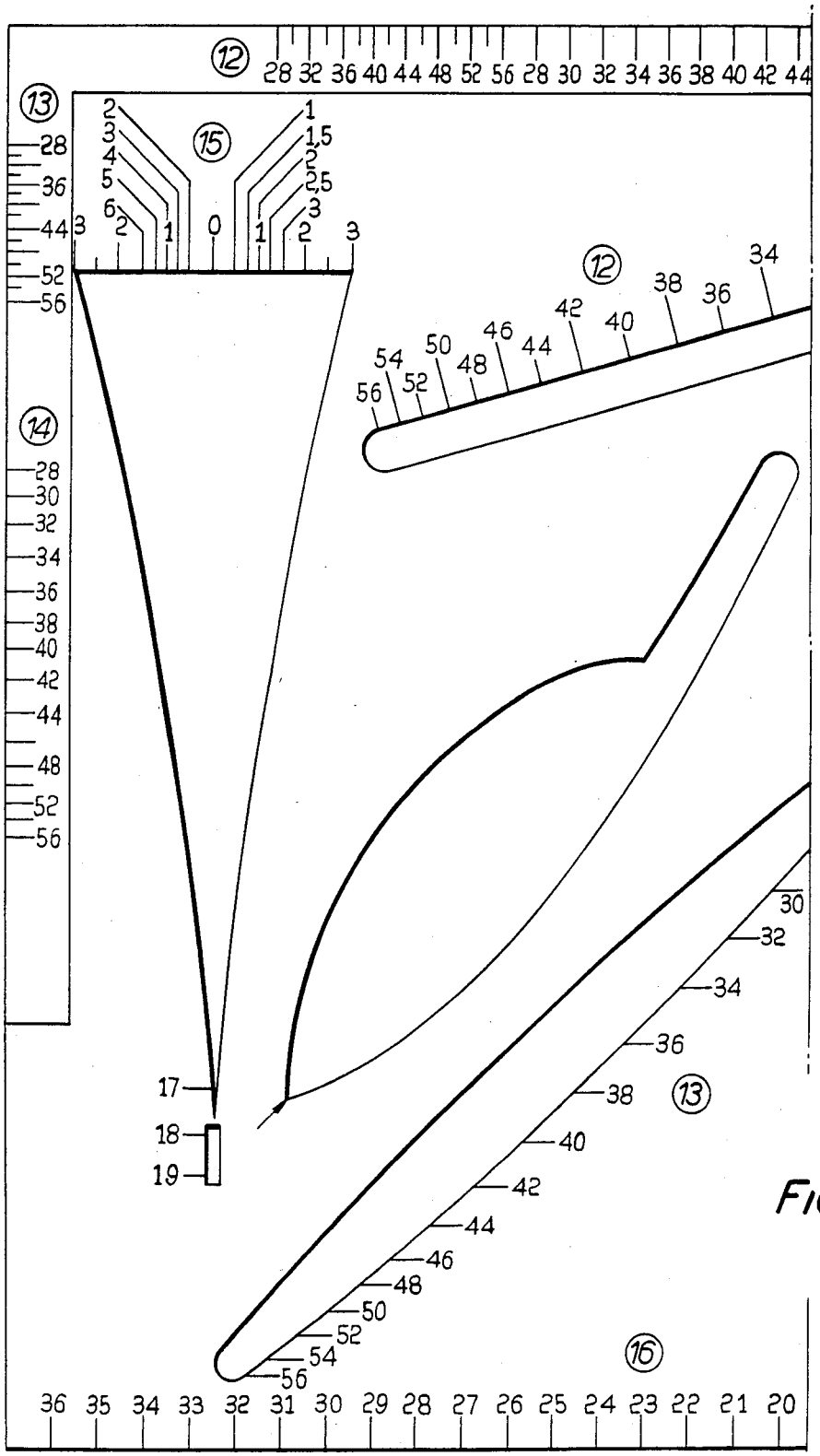
FIGS. 2A and 2B show reverse side of the template of FIG. 1.
Figure 2B:
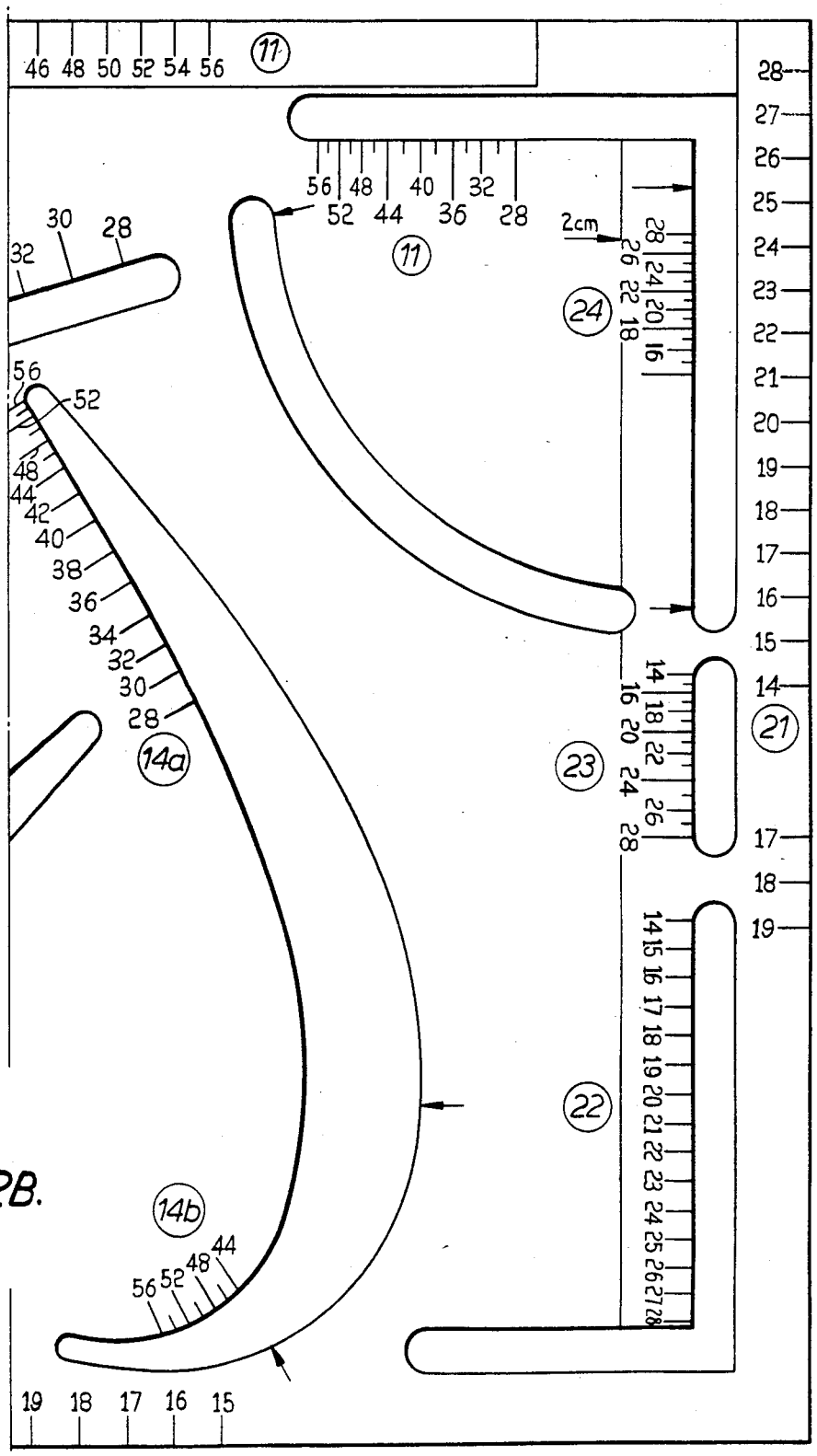

Referring firstly to FIGS. 1A, 1B, 2A, and 2B the template is 35 cm long, 30 cm wide and about to to 3 mm thick. It therefore has two faces, front and back; the front is intended for use in marking patterns for the front of a garment and the back for marking patterns for the back, as will be described in more detail below.

The template has a series of apertures resulting in a variety of straight and curved edges Part of these are marked with scales, on both sides of the template for making the desired pattern.

The scales are graded (based on the body measurements taken) to represent the various garment sizes. They are stamped on the edges of the apertures or on the sides of the template and apertures are numbered according to the sequence of the work process.

The upper and left sides of the front part of the template have scales marked in cm (1–30 cm and 1–35 cm respectively) which are used for horizontal and perpendicular measurements and form a part of the overall process together with the remainder of the instrument.

On the front part of the template there are the following scales:

Scales Nos. 1, 2 and 3 which are graded from 28–56 (based on the chest width) are used for marking and designing the neckline curve.

The scale Nos. 4, 5, *6a* and *6b*, which are graded from 28–56 (based on the chest width) are used for marking the shoulder and armhole points and the design of the armhole curve, (children and adults separately).

Scale Nos. 7 and 8 which are graded from 1–9 (based on the difference between the chest and bust widths) are used for marking and designing the shoulder and waist darts on the bodice.

Scale No. 9, which is graded from 15–32 (based on the waist and hip widths) is used for the marking of the front waist e1ther for the bodice part or for the skirt part as we11 as the front hip.

Scale No. 10, which is graded from 2–6 (based on the difference between the waist and hip widths) has been designed in a way that it can give and mark the slanting lines (either the darts or half-darts) of the skirt part so that they can match those of the bodice part, to achieve a perfect figure fit.

On the front part of the template there are also three arrow shaped markers that are used as starting or guiding points for the correct placing of the instrument during various stages of the work process.

On the back part of the template there are the following scales.

Scale No. 11, which is graded from 28–56 (based on the chest width) is used for the marking and designing the neckline curve.

Scale Nos. 2, 3, 4*a* and 4*b*, which are graded from 28–56 (based on the chest width) are used for marking the shoulder and armhole points and the design of the armhole curve.

Scale No. 5, graded from 2–6 (based on the difference between the waist and hip widths) has been designed so that it can give and mark the slanting lines of the skirt part so that they can match those of the bodice part.

Scale No. 6, which is graded from 15–36 (based on the waist and hip widths) is used to design the back waist and hip parts.

Sleeve scales 11, 12, 13 and 14, which are graded from 28–56 (based on the chest width) are used for the marking and making of the sleeve pattern, with the use of the corresponding marked sleeve curves.

Trouser scales 21, 22, 23 and 24, which are graded from 14–28 (based on the hip width) are used with aid of the corresponding crotch curve for the design of the trouser pattern.

On the back of the template there are also six arrow shaped markers which are used as guiding points for the correct placing of the instrument during various stages of the work process.

By using the appropriate apertures and scales it is possible to generate a pattern for various complete garments.

The construction of the simple bodice block (no darts) is possible. The bodice block which is very simply made with no darts and can be used for making various shirt and blouse designs. The construction of the main bodice block (all darts included) is more simply achieved by using a template in accordance with the invention to provide a bodice block pattern with a perfect fit.

The construction of the main whole dress block pattern (all darts included) is also simply achieved. It is believed that the present invention is revolutionary in enabling the construction of the dress block pattern because for the first time it is possible to match the slanting lines (darts and half-darts) of the upper and lower figure parts (whatever body proportions given) to produce a perfectly fitting block pattern which realises the body measurement with precision. The construction of the Sleeve Block is also possible: The Sleeve Block is very simply made to fit the bodice block for which it has been designed. Finally, the construction of the trouser block is possible for the construction of trousers in all sizes using the revolutionary and simple method of the invention.

The marking of a pattern for one front quarter of a dress will now be described in more detail in order to illustrate the invention. It is to be understood that a similar procedure would be followed to produce the corresponding rear quarter using the back face and that mirror images of these patterns could be used for the two other quarters. Furthermore, it is to be understood that similar procedures can be followed to produce other garment types in other sizes.

FIGS. 3 to 15 show successive stages in the preparation of a pattern of a front quarter of a dress.

Figure 3:
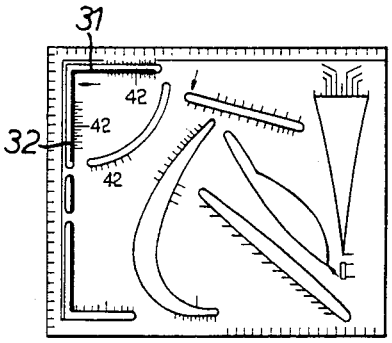
FIGS. 3 to 15 show successive stages in the preparation of a pattern of a front quarter of a dress.
Figure 4:
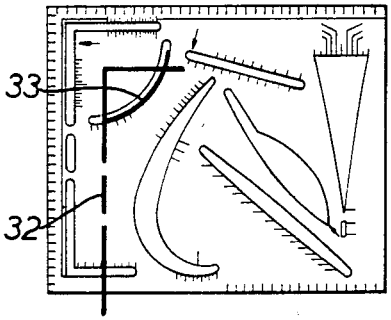

The first horizontal line 31 is drawn perpendicular to the Centre Front Line 32, and with the template in this position, the neckline curve points are marked using scales 1 and 2 for a bust size measurement of 42 cm (FIG. 3). The neckline curve 33 is then drawn using scale 3 (FIG. 4).

Figure 5:
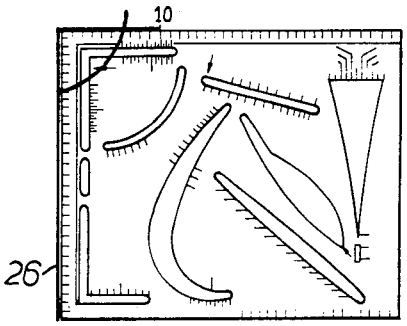
Figure 6:
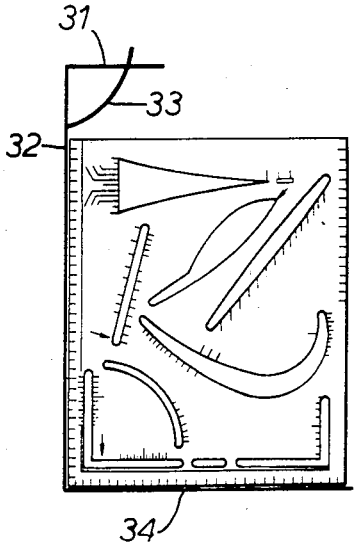

Next, the bust width (as measured - in this case 10 cm) is marked on the first horizontal line 31 and the bust height (as measured - in this case 26 cm) is marked on the Centre Front Line 32 (FIG. 5). The waist horizontal line 34 is then drawn at the measured position, in this case 34 cm (FIG. 6).

Figure 7:
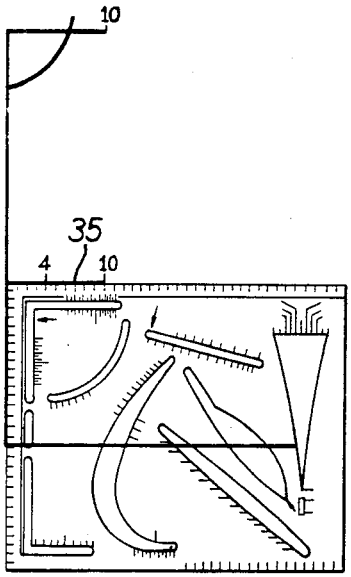
Figure 9:
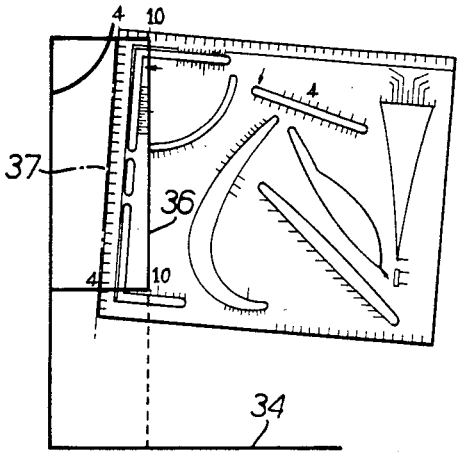
Figure 8:
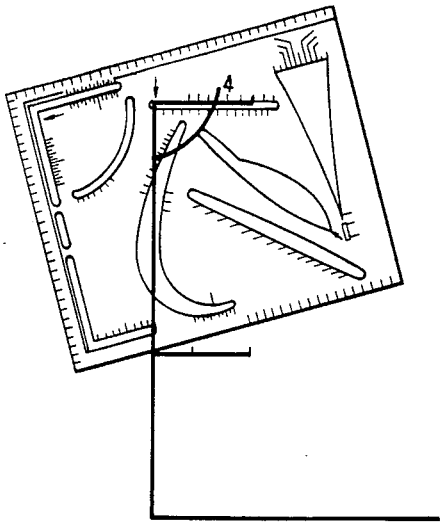

From the bust height point a horizontal line 35 is drawn and marked with the bust width (10 cm) and the difference between the bust width and the chest width - in this case 4 cm (FIG. 7). Then, using scale 7, this same difference is marked on the first horizontal line 31 (FIG. 8). The two points representing the bust width are joined by a slanting line 36 and the two points representing the difference between bust and chest width are joined by a further slanting line 37 (FIG. 9).

Figure 10:
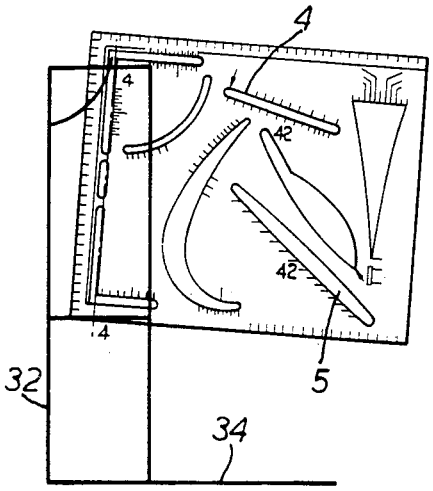
Figure 11:
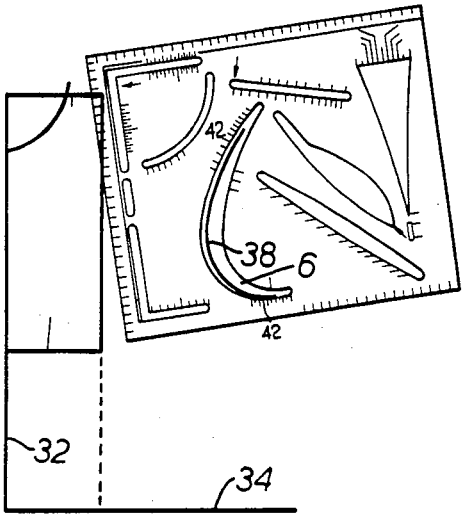

Next, the template is placed with the slanting line 38 along scale 1 as shown in FIG. 10 and the shoulder and armhole points are marked on scales 4 and 5 at a position corresponding to the 42cm measurement. The armhole curve 38 is then drawn using scales 6*a* and 6*b*, joining up the shoulder and armhole points (FIG. 11).

Figure 13:
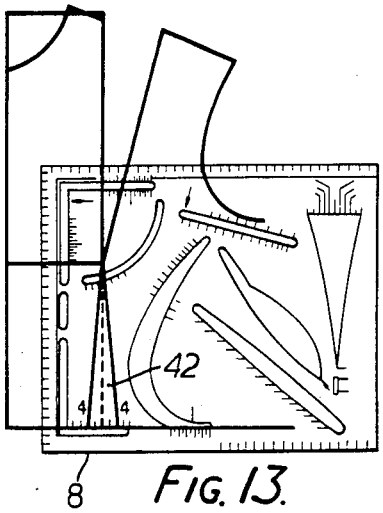
Figure 12:
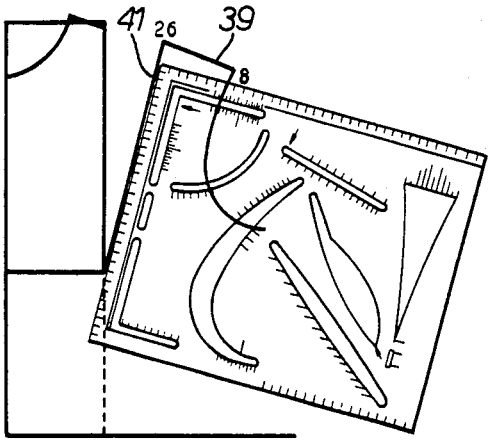
Figure 14:
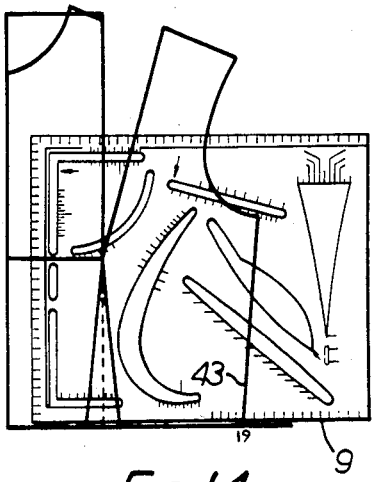
Figure 15:
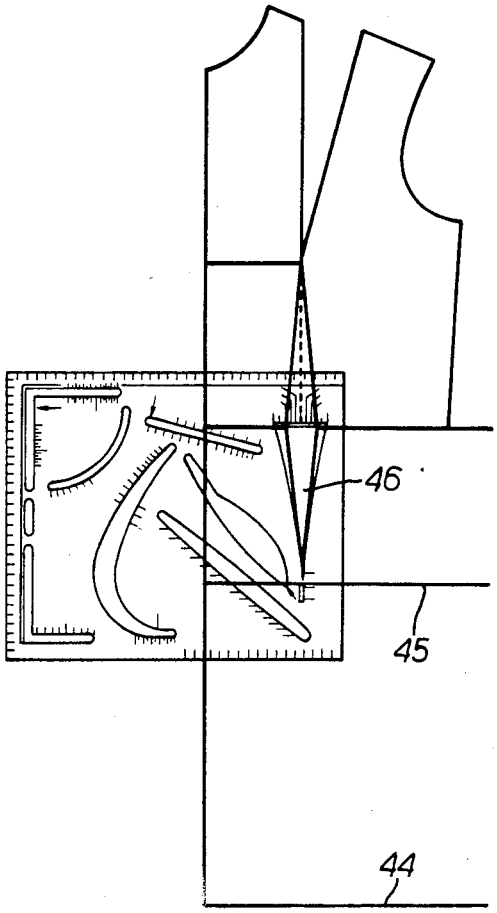

Starting from the armhole curve 38, the remainder of the measured shoulder width is marked and from that point, the shoulder dart line 41 is drawn to the bust width point, and the shoulder line 39 is drawn (FIG. 12) using scale 8, the waist dart 42 is then drawn by centering the slanting line 36 in the scale 8 aperture and marking off points corresponding to the chest/bust width difference (FIG. 13). Leaving out the waist dart width, the waist measurement is then marked using scale 9 and the side line 43 is marked to close up the side (FIG. 14).

In order to continue with the lower part, to complete the dress, the length of the garment is marked and the hemline 44 is drawn. The hip height is then measured and marked and a horizontal line 45 is drawn. The appropriate hip dart 46 is drawn using scale 10 for the front (and scale 15 for the back) so that it matches the waist dart 42 precisely (FIG. 15) depending upon the difference between waist and hip measurements and the resulting slant line. The dart produced varies according to that difference and the waist dart. The hip measurement is then marked and the hem circumference to complete the front quarter of the dress.

Obviously, numerous modifications and variations of the present invention are possible in the light of the above teachings. It is therefore to be understood that within the scope of the appended claims, the invention may be practiced otherwise than as specifically described herein.

I claim:

1. A template for marking a pattern for the manufacture of a garment to fit any individual having any particular range of size measurements, said template comprising a flat plate, a series of apertures formed in said flat plate, at least some of said apertures having contours conforming in shape to a desired pattern, said template further comprising scales marked on at least some of said apertures, said scales representing different sizes, said scales including at least one scale for use in connection with the difference between a chest width and a bust width of a person which said garment is intended to fit, said scale being for use in marking shoulder and waist darts on said pattern and being so calibrated in relation to said difference between said chest width and said bust width that said darts result in said pattern being an accurate fit in three dimensions.

2. A template according to claim 1, wherein said apertures are marked with scales for forming a front section of said garment on one side of said plate and said apertures are marked with said scales on the other side of said plate for a rear section of said garment.

3. A template according to claim 1 including an aperture for marking a curve corresponding to a neckline on said garment.

4. A template according to claim 1 including an aperture for marking curves corresponding to a shoulder and an armhole on said garment.

5. A template according to claim 1 including an aperture for marking curves corresponding to crotch curves for a trouser pattern.

6. A template according to claim 1 including at least one scale for use in connection with a chest width of a person, which person said garment is intended to fit, said scale being for use in making neckline, shoulder, armhole and/or sleeve points on said pattern.

7. A template according to claim 1, including at least one scale for use in connection with a waist width and a hip width of a person, which person said garment is intended to fit, said scale being for use in marking waist and hip dimensions on said pattern.

8. A template according to claim 1, including at least one scale for use in connection with the difference between a waist width and a hip width of a person, which person said garment is intended to fit, said scale being for use in marking dart lines for a skirt or trousers which match precisely corresponding waist dart lines on a bodice.

9. A template according to claim 1, including at least one scale for use in connection with a hip width of a person, which, person said garment is intended to fit, said scale being for use in marking trouser points on said pattern.

10. A template according to claim 1, including at least one scale for marking a sleeve pattern.

11. A template according to claim 1, including indication marks at certain of said apertures at positions correlating lines of said pattern which have already been drawn with further lines of said pattern yet to be drawn.

12. A template according to claim 1, including straight line scales on its outer periphery.

* * * * *